US010071591B1

(12) United States Patent
Peyton

(10) Patent No.: US 10,071,591 B1
(45) Date of Patent: Sep. 11, 2018

(54) PEN ASSEMBLY

(71) Applicant: Jerry F. Peyton, Oro Valley, AZ (US)

(72) Inventor: Jerry F. Peyton, Oro Valley, AZ (US)

(73) Assignee: KINGDOM PENS, LLC, Oro Valley, AZ (US)

( * ) Notice: Subject to any disclaimer, the term of this patent is extended or adjusted under 35 U.S.C. 154(b) by 0 days.

(21) Appl. No.: 15/843,458

(22) Filed: Dec. 15, 2017

(51) Int. Cl.
*B43K 24/02* (2006.01)
*B43K 23/12* (2006.01)
*B43K 7/00* (2006.01)

(52) U.S. Cl.
CPC ..... *B43K 23/12* (2013.01); *B43K 7/00* (2013.01); *B43K 24/026* (2013.01)

(58) Field of Classification Search
CPC ..... B43K 7/12; B43K 24/026
USPC ..... 401/117
See application file for complete search history.

(56) References Cited

U.S. PATENT DOCUMENTS

| | | | |
|---|---|---|---|
| 866,148 | A | 9/1907 | Levingston |
| 2,435,185 | A | 1/1948 | Reynolds |
| 2,559,555 | A | 7/1951 | Zepelovitch |
| 2,941,511 | A | 6/1960 | Cieremans |
| 3,740,159 | A | 6/1973 | Smagala-Romanoff |
| 4,580,919 | A | 4/1986 | Ambasz |
| 4,679,954 | A | 7/1987 | Ambasz |
| 4,780,016 | A | 10/1988 | Kim |
| D321,718 | S | 11/1991 | Ambasz |
| 6,830,402 | B2 | 12/2004 | Sunatori |
| 8,641,308 | B2 | 2/2014 | Peyton et al. |
| 9,370,960 | B2 | 6/2016 | Peyton et al. |
| 2015/0125199 | A1 | 5/2015 | Peyton et al. |

FOREIGN PATENT DOCUMENTS

| | | | |
|---|---|---|---|
| WO | WO2013166145 | A1 | 11/2013 |

*Primary Examiner* — David Walczak
*Assistant Examiner* — Joshua Wiljanen

(57) ABSTRACT

A pen system comprising a cover member joined to an adapter having an anterior end of an ink cartridge disposed therein is disclosed. A pen housing covers the ink cartridge and is sealed via a plug. In one embodiment, a slit divides a surface of the adapter to allow a collapse of the adapter, thus narrowing a height of the adapter, to allow insertion of the adapter into the cover member. A first and second annular groove are disposed at a center of the adapter, where each annular groove interfaces with a cover member annular ridge to define an open and closed position of the pen. In an alternate embodiment, an annular washer having an annular ridge is disposed in the cover member, in place of the cover member annular ridge, to interface with the first and second annular groove thus defining the open and closed positions of the pen.

13 Claims, 3 Drawing Sheets

PEN ASSEMBLY

FIELD OF THE INVENTION

The present invention relates to a ballpoint pen, more specifically, to a system for easily assembling a cap portion to a body portion of a ballpoint pen.

BACKGROUND OF THE INVENTION

The ever-popular ballpoint pen has been in use since the late 1800's having representations of the modern version dating to the 1940's. Ballpoint pens typically consist of a writing instrument with an internal ink reservoir that dispenses ink from a tip having a roller ball. In the beginning, the ballpoint pen was developed as a fine writing utensil, but through the years a branch of ballpoint pens has been mostly made of plastic. A primary advantage inherent to the ballpoint pen design, besides the low cost, includes a resistance to ink leakage. The present invention discloses a novel, yet inexpensive and easy to use, ballpoint pen system.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

A pen system comprising a cover member joined to an adapter having an anterior end of an ink cartridge disposed therein is herein disclosed. A pen housing covers the ink cartridge and is sealed via a plug. In one embodiment, a slit divides a surface of the adapter to allow a collapse of the adapter, thus narrowing a height of the adapter, to allow insertion of the adapter into the cover member. A first and second annular groove are disposed at a center of the adapter, where each annular groove interfaces with a cover member annular ridge to define an open and closed position of the pen. In an alternate embodiment, an annular washer having an annular ridge is disposed in the cover member, in place of the cover member annular ridge, to interface with the first and second annular groove thus defining the open and closed positions of the pen.

Currently technology in ballpoint pen assemblies lack a cap that covers and uncovers the ink cartridge without having to be removed from the pen body. One of the unique and inventive technical features of the present invention is the use of such a cap that can be assembled in one step. Without wishing to limit the invention to any theory or mechanism, it is believed that the technical feature of the present invention advantageously provides for a "stick" ballpoint pen with a sliding, non-removable cap manufactured as inexpensively as standard ballpoint pens with removable caps. None of the presently known prior references or work has the unique inventive technical feature of the present invention.

BRIEF DESCRIPTION OF THE DRAWINGS

The features and advantages of the present invention will become apparent from a consideration of the following detailed description presented in connection with the accompanying drawings in which.

DETAILED DESCRIPTION OF THE INVENTION

Figure 1A:
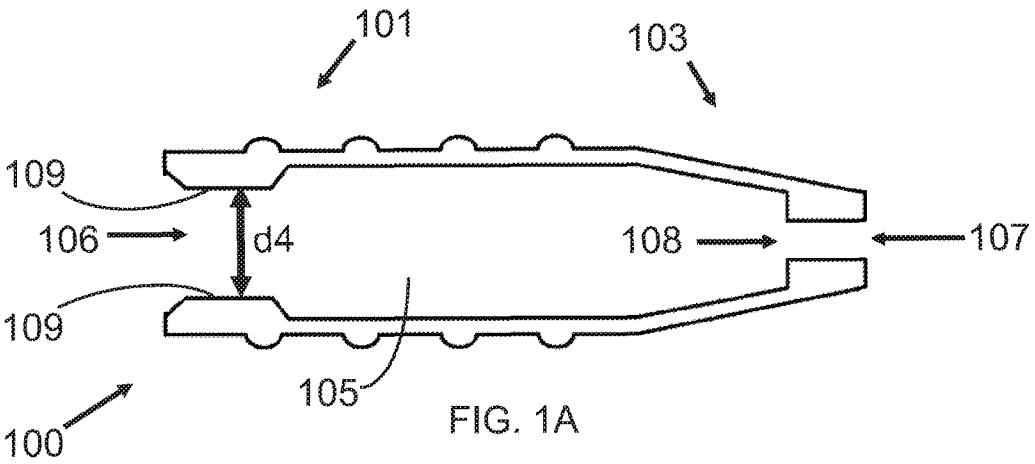
FIG. 1A shows the cover member (alternately, the cap) of a first embodiment of the present invention.
Figure 1B:
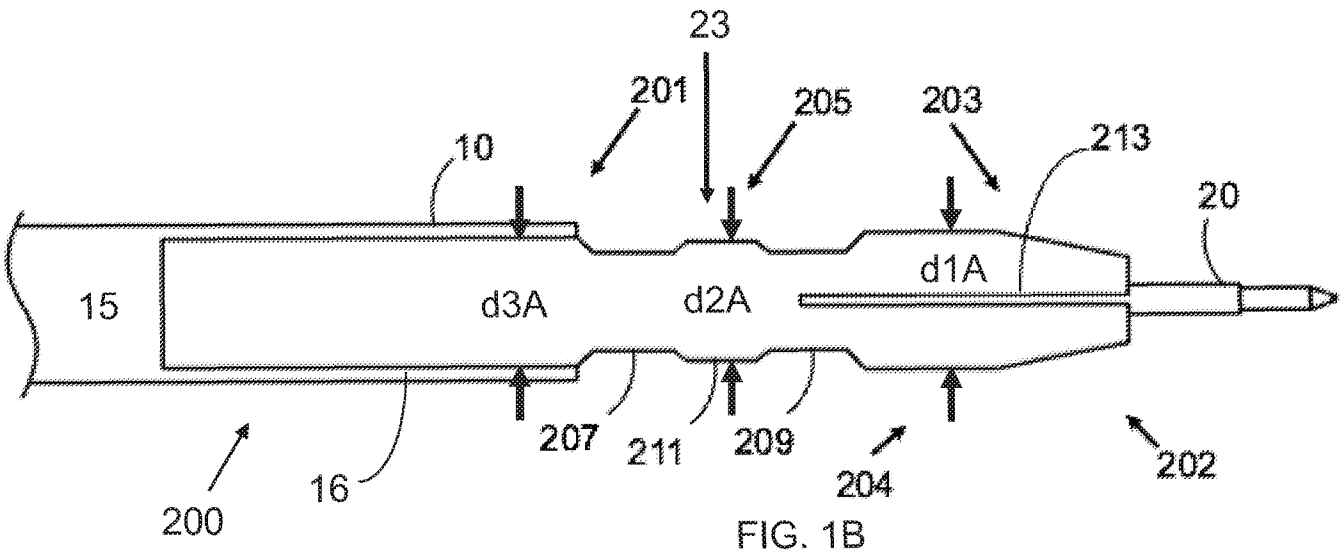
FIG. 1B shows the adapter (alternately, the insert) of a first embodiment of the present invention.
Figure 2C:
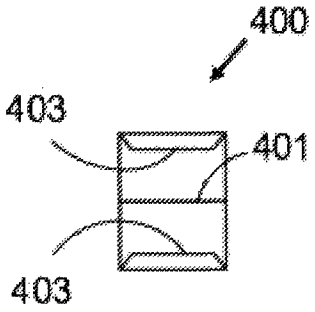
FIG. 2C shows the annular washer of the second embodiment of the present invention.
Figure 2A:
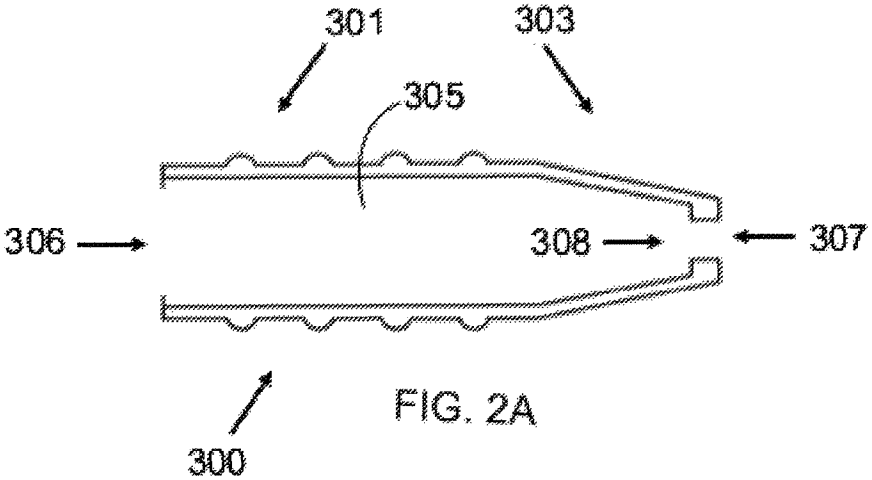
FIG. 2A shows the cap of a second embodiment of the present invention.
Figure 2B:
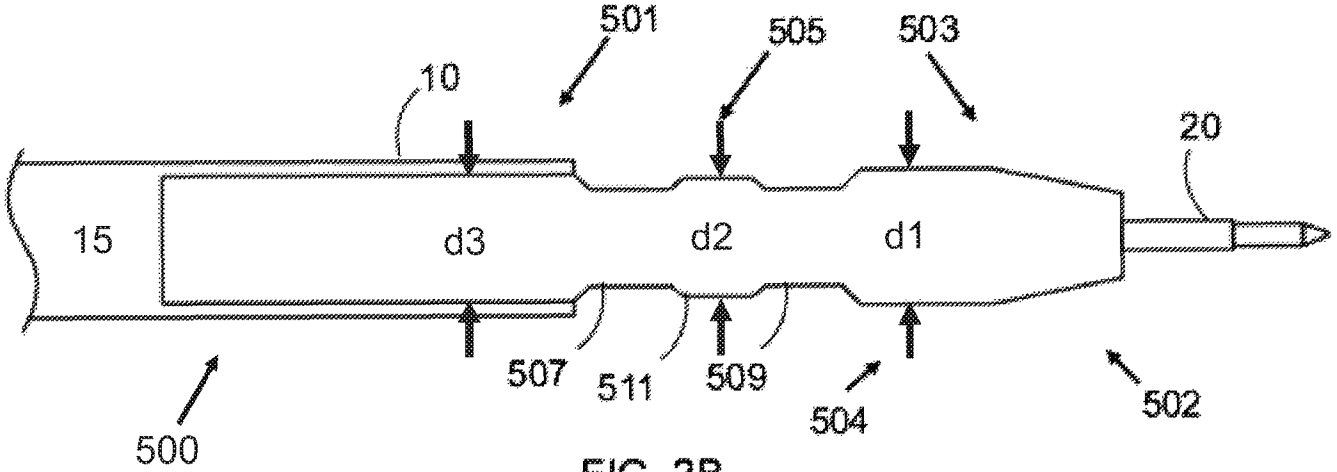
FIG. 2B shows the insert of the second embodiment of the present invention.
Figure 3:
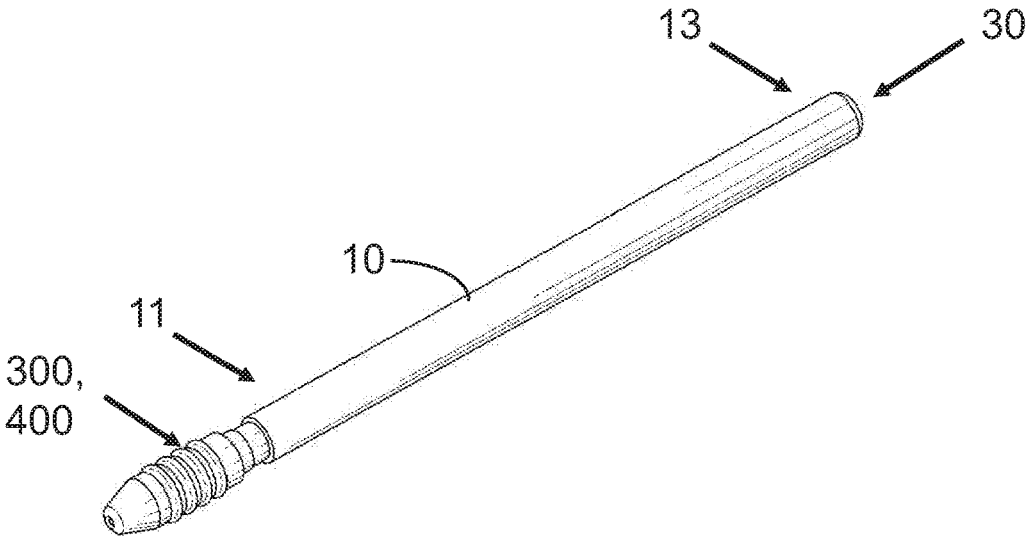
FIG. 3 shows an external view of a fully assembled pen in accordance with both the first and second embodiments.
Figure 4:
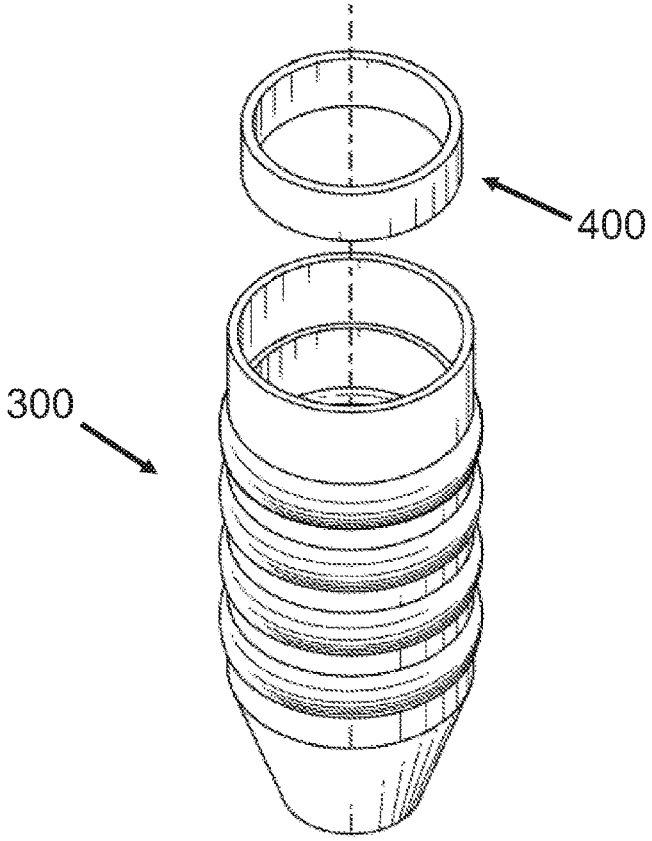
FIG. 4 shows an alternate view of the cap and annular washer in accordance with the second embodiment.

Following is a list of elements corresponding to a particular element referred to herein:

10 pen housing
11 housing anterior end
13 housing posterior end
15 housing cavity
20 ink cartridge
30 plug
100 cover member
101 proximal cover member end
103 distal cover member end
105 cover member cavity
106 proximal cover member aperture
107 distal cover member aperture
108 distal cover member channel
109 cover member annular ridge
200 adapter
201 adapter posterior section
202 distal anterior section end
203 adapter anterior section
204 proximal anterior section end
205 adapter midsection
207 first adapter annular groove
209 second adapter annular groove
211 adapter annular ridge
213 slit
300 cover member
301 proximal cover member
303 distal cover member
305 cover member cavity
306 proximal cover member aperture
307 distal cover member aperture
308 distal cover member channel
400 annular washer
401 narrow opening
403 washer annular ridge
500 adapter
501 adapter posterior section
502 distal anterior section
503 adapter anterior section
504 proximal anterior section
505 adapter midsection
507 first adapter annular groove
509 second adapter annular groove
511 adapter annular ridge Referring now to FIGS. 1A-4, the present invention features a pen assembly comprising a cover member (100) and an adapter (200). In some embodiments, the cover member (100) comprises: a proximal cover member end (101), having a proximal cover member aperture (106); a distal cover member end (103), having a distal cover member channel (108) fluidly connected to a distal cover member aperture (107); and a cover member cavity (105) fluidly connected to the proximal cover member aperture (106) and the distal cover member channel (108). In an embodiment, a cover member annular ridge (109) is disposed within the cover member cavity (105) at the proximal cover member end (101).

In other embodiments, the adapter (200) has an adapter posterior section (201), an adapter anterior section (203), and an adapter midsection (205). In an embodiment, the adapter anterior section (203) has a proximal anterior section end (204) and a distal anterior section end (202). In another embodiment, a geometry of the adapter anterior section (203) is such that an adapter anterior section diameter decreases from the proximal anterior section end (204) to the distal anterior section end (202). In an embodiment, an exterior diameter, d1A, of the adapter anterior section (203) at the cover member annular ridge (109), upon compression, approaches the maximum adapter midsection (205) exterior diameter, d2A. In other embodiments, the adapter (200) further comprises an adapter annular ridge (211) disposed on the cross-section of the transverse plane of the adapter midsection (205). In one embodiment, d2A is smaller than an exterior diameter, d3A, of the adapter posterior section (201). In another embodiment, d1A may be smaller than d3A due to compression of a slit (213) in the surface of the adapter anterior section (203). The following provides non-limiting examples of the sizes of the previously mentioned diameters: d1A is ~0.5 mm, d2A is ~0.46 mm, and d3A ~0.5 mm.

In some embodiments, d3A is small enough to snugly fit into a tube (16). The depth of the tube is large enough to prevent the cover member (100) from sliding backwards.

In some embodiments, the adapter (200) and tube (16) can be a single extrusion.

A first adapter annular groove (207) may be disposed on a cross-section of a transverse plane of the adapter midsection (205) between the adapter posterior section (201) and the adapter annular ridge (211). Further, a second adapter annular groove (209) may be disposed on the cross-section of the transverse plane of the adapter midsection (205) between the adapter anterior section (203) and the adapter annular ridge (211). In another embodiment, a slit (213) is disposed through a surface of the adapter anterior section (203). In a preferred embodiment, the slit (213) extends a length of the adapter anterior section (203) and terminates at the adapter midsection (205).

Consistent with previous embodiments, the adapter anterior section (203) is configured to be inserted into the cover member cavity (105), via the proximal cover member aperture (106). In exemplary embodiments, said insertion causes the cover member (100) to compress the adapter anterior section (203) and close the slit (213). d1A is thus effectively reduced, as a result of the closed slit (213). This reduction allows the proximal cover member end (101) to pass over the adapter anterior section (203). In preferred embodiments, the cover member annular ridge (109) then snuggly and slidably interfaces with the second adapter annular groove (209) to define a first position of the pen assembly.

In some embodiments, a first movement of the cover member (100) towards the adapter posterior section (201) moves the pen assembly from the first position to a second position. The flexibility of the cover member (100), allows the cover member (100) to slide over the adapter annular ridge (211). In other embodiments, the second position is defined by the cover member annular ridge (109) snuggly and slidably interfacing with the first adapter annular groove (207). In an embodiment, a second movement of the cover member (100) towards the adapter anterior section (203) moves the pen assembly from the second position back to the first position. In another embodiment, while in the first position, the cover member (100) is prevented from being detached from the adapter (200) as a result of a height of the first annular ridge (109) relative to a first depth. The first depth may be defined as a depth of the second adapter annular groove (209) relative to the adapter anterior section (203). In yet other embodiments, while in the second position, the cover member (100) is prevented from being moved beyond the adapter posterior section (201) as a result of the height of the first annular ridge (109) relative to a second depth. The second depth may be defined as a depth of the first adapter annular groove (207) relative to the adapter posterior section (201). As a nonlimiting example, the first and second depths may each be about 0.05 mm.

In additional embodiments, the pen assembly further comprises:

- an adapter channel disposed along a central axis of the adapter (200) and extending a length of the adapter (200);
- a pen housing (10) having a housing anterior end (11), a housing posterior end (13), and a housing cavity (15) fluidly coupled to a housing anterior end aperture and a housing posterior end aperture;
- an ink cartridge (20); and
- a plug (30).

In some embodiments, prior to joining the cover member (100) and the adapter (200), the ink cartridge (20) is inserted into the adapter channel such that the ink cartridge (20) extends beyond the distal anterior section end (202) and a portion of the ink cartridge (20) extends beyond the adapter posterior section (201). In other embodiments, the extending portion is then inserted into the housing cavity (15) and the adapter posterior section (201) is slidably inserted into the housing cavity (15), via the housing anterior end aperture. The plug (30) may then be sealably attached to the housing posterior end aperture, and the cover member (100) may then joined to the adapter (200).

In supplementary embodiments, the first position is an open position, where the ink cartridge (20) extends through the distal cover member channel (108) and beyond the distal cover member aperture (107). The second position may be a closed position, where the ink cartridge (20) resides within the distal cover member channel (108).

In some embodiments, the cover member (100) has external ribs disposed longitudinally on a top surface of the cover member (100). In an alternate embodiment, the cover member (100) has external ribs disposed annularly on a top surface of the cover member (100).

The present invention additionally features an alternate pen assembly comprising a cover member (300). an annular washer (400), and an adapter (500). In some embodiments, the cover member (300) comprises: a proximal cover member end (301), having a proximal cover member aperture (306); a distal cover member end (303), having a distal cover member channel (308) fluidly connected to a distal cover member aperture (307); and a cover member cavity (305) fluidly connected to the proximal cover member aperture (306) and the distal cover member channel (308). In an embodiment, the annular washer (400) has a narrow opening (401) and a washer annular ridge (403).

In other embodiments, the adapter (500) has an adapter posterior section (501), an adapter anterior section (503), and an adapter midsection (505). In an embodiment, the adapter anterior section (503) has a proximal anterior section end (504) and a distal anterior section end (502). In another embodiment, a geometry of the adapter anterior section (503) is such that an adapter anterior section diameter decreases from the proximal anterior section end (504) to the distal anterior section end (502). In other embodiments, the adapter (500) further comprises an adapter annular ridge (511) disposed on the cross-section of the transverse plane of the adapter midsection (505). In an embodiment, the maximum adapter anterior section exterior diameter, d1, is larger than an exterior diameter, d2, of the adapter annular ridge (511). As a nonlimiting example, the size of d1 may be about 0.5 mm and the size of d2 may be about 0.46 mm.

A first adapter annular groove (507) may be disposed on a cross-section of a transverse plane of the adapter midsection (505) between the adapter posterior section (501) and the adapter annular ridge (511). Further, a second adapter annular groove (509) may be disposed on the cross-section of the transverse plane of the adapter midsection (505) between the adapter anterior section (503) and the adapter annular ridge (511).

Consistent with previous embodiments, the second adapter annular groove (509) is inserted into the annular washer (401), via the narrow opening (401), such that the washer annular ridge (403) snuggly and slidably interfaces with the second adapter annular groove (509). In an embodiment, the adapter anterior section (503) is inserted into the cover member cavity (305), via the proximal cover member aperture (306), such that an external surface of the annular washer (400) contacts an interior surface of the proximal cover member (301) and is attached via an adhesive. In an exemplary embodiment, the annular washer (400) is flush with the proximal cover member (301) while the washer annular ridge (403) snuggly and slidably interfaces with the second adapter, thus defining a first position of the pen assembly.

In some embodiments, a first movement of the cover member (300) towards the adapter posterior section (501) moves the pen assembly from the first position to a second position. In preferred embodiments, the second position is defined by the washer annular ridge (403) snuggly and slidably interfacing with the first adapter annular groove (507). In an embodiment, a second movement of the cover member (300) towards the adapter anterior section (503) moves the pen assembly from the second position back to the first position. In another embodiment, while in the first position, the cover member (300) is prevented from being detached from the adapter (500) as a result of a height of the washer annular ridge (403) relative to a first depth. The first depth may be defined as a depth of the second adapter annular groove (509) relative to the adapter anterior section (503). In yet other embodiments, while in the second position, the cover member (300) is prevented from being moved beyond the adapter posterior section (501) as a result of the height of the washer annular ridge (403) relative to a second depth. The second depth may be defined as a depth of the first adapter annular groove (507) relative to the adapter posterior section (501). As a nonlimiting example, the first and second depths may each be about 0.05 mm.

In additional embodiments, the pen assembly further comprises:

an adapter channel disposed along a central axis of the adapter (500) and extending a length of the adapter (500);

a pen housing (10) having a housing anterior end (11), a housing posterior end (13), and a housing cavity (15) fluidly coupled to a housing anterior end aperture and a housing posterior end aperture;

an ink cartridge (20); and a plug (30).

In some embodiments, prior to joining the cover member (300) and the adapter (500), the ink cartridge (20) is inserted into the adapter channel such that the ink cartridge (20) extends beyond the distal anterior section end (502) and a portion of the ink cartridge (20) extends beyond the adapter posterior section (501). In other embodiments, the extending portion is then inserted into the housing cavity (15) and the adapter posterior section (501) is slidably inserted into the housing cavity (15), via the housing anterior end aperture. The plug (30) may then be sealably attached to the housing posterior end aperture, and the cover member (300) may then joined to the adapter (500).

In supplementary embodiments, the first position is an open position, where the ink cartridge (20) extends through the distal cover member channel (308) and beyond the distal cover member aperture (307). The second position may be a closed position, where the ink cartridge (20) resides within the distal cover member channel (308).

In some embodiments, the cover member (300) has external ribs disposed longitudinally on a top surface of the cover member (300). In an alternate embodiment, the cover member (300) has external ribs disposed annularly on a top surface of the cover member (300). In other embodiments, the maximum anterior section diameter, d1, is equal to a diameter, d3, of the adapter posterior section (501).

As used herein, the term "about" refers to plus or minus 10% of the referenced number.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. Reference numbers recited in the claims are exemplary and for ease of review by the patent office only, and are not limiting in any way. In some embodiments, the figures presented in this patent application are drawn to scale, including the angles, ratios of dimensions, etc. In some embodiments, the figures are representative only and the claims are not limited by the dimensions of the figures. In some embodiments, descriptions of the inventions described herein using the phrase "comprising" includes embodiments that could be described as "consisting of", and as such the written description requirement for claiming one or more embodiments of the present invention using the phrase "consisting of" is met.

The reference numbers recited in the below claims are solely for ease of examination of this patent application, and are exemplary, and are not intended in any way to limit the scope of the claims to the particular features having the corresponding reference numbers in the drawings.

What is claimed is:

1. A pen assembly comprising:

(a) a cover member (100) having;

(i) a proximal cover member end (101) having a proximal cover member aperture (106);

(ii) a distal cover member end (103) having a distal cover member channel (108) fluidly connected to a distal cover member aperture (107); and (iii) a cover member cavity (105) fluidly connected to the proximal cover member aperture (106) and the distal cover member channel (108), wherein a cover member annular ridge (109) is disposed within the cover member cavity (105) at the proximal cover member end (101); and (b) an adapter (200) having an adapter posterior section (201), an adapter anterior section (203), and an adapter midsection (205), wherein the adapter anterior section (203) has a proximal anterior section end (204) and a distal anterior section end (202), wherein a geometry of the adapter anterior section (203) is such that an adapter anterior section diameter decreases from the proximal anterior section end (204) to the distal anterior section end (202), wherein an exterior diameter, (d1A), of the adapter anterior section (203) at the cover member annular ridge (109), upon compression, approaches the maximum adapter midsection (205) exterior diameter, (d2A), wherein the adapter (200) further comprises:

(i) an adapter annular ridge (211) disposed on the cross-section of the transverse plane of the adapter midsection (205), wherein the diameter, (d1A), is comparable to the exterior diameter, (d3A), of the adapter posterior section (201);

(ii) a first adapter annular groove (207) disposed on a cross-section of a transverse plane of the adapter midsection (205) between the adapter posterior section (201) and the adapter annular ridge (211);

(iii) a second adapter annular groove (209) disposed on the cross-section of the transverse plane of the adapter midsection (205) between the adapter anterior section (203) and the adapter annular ridge (211); and (iv) a slit (213) disposed through a surface of the adapter anterior section (203), wherein the slit (213) extends a length of the adapter anterior section (203) and terminates at the adapter midsection (205), wherein the adapter anterior section (203) is configured to be inserted into the cover member cavity (105), via the proximal cover member aperture (106), causing the cover member (100) to compress the adapter anterior section (203), closing the slit (213), and thus allowing the proximal cover member end (101) to slide over the adapter anterior section (203), wherein the cover member annular ridge (109) snuggly and slidably interfaces with the second adapter annular groove (209), thus defining a first position of the pen assembly, wherein a first movement of the cover member (100) towards the adapter posterior section (201) moves the pen assembly from the first position to a second position such that the cover member annular ridge (109) snuggly and slidably interfaces with the first adapter annular groove (207), wherein a second movement of the cover member (100) towards the adapter anterior section (203) moves the pen assembly from the second position back to the first position, wherein, while in the first position, the cover member (100) is prevented from being detached from the adapter (200) as a result of a height of the first annular ridge (109) relative to a first depth, which is a depth of the second adapter annular groove (209) relative to the adapter anterior section (203), wherein, while in the second position, the cover member (100) is prevented from being moved beyond the adapter posterior section (201) as a result of the height of the first annular ridge (109) relative to a second depth, which is a depth of the first adapter annular groove (207) relative to the adapter posterior section (201).

2. The pen assembly of claim 1 further comprising:

(a) an adapter channel disposed along a central axis of the adapter (200) and extending a length of the adapter (200);

(b) a pen housing (10) having a housing anterior end (11), a housing posterior end (13), and a housing cavity (15) fluidly coupled to a housing anterior end aperture and a housing posterior end aperture;

(c) an ink cartridge (20); and (d) a plug (30).

wherein, prior to joining the cover member (100) and the adapter (200), the ink cartridge (20) is inserted into the adapter channel such that the ballpoint tip extends beyond the distal anterior section end (202) and a portion of the ink cartridge (20) extends beyond the adapter posterior section (201), wherein the extending portion is then inserted into the housing cavity (15) and the adapter posterior section (201) is slidably inserted into the housing cavity (15), via the housing anterior end aperture, wherein the plug (30) is then sealably attached to the housing posterior end aperture, wherein the cover member (100) is then joined to the adapter (200).

3. The pen assembly of claim 2, wherein the first position is an open position, wherein the ink cartridge (20) extends through the distal cover member channel (108) and beyond the distal cover member aperture (107).

4. The pen assembly of claim 2, wherein the second position is a closed position, wherein the ink cartridge (20) resides within the distal cover member channel (108).

5. The pen assembly of claim 1, wherein the cover member (100) has external ribs disposed longitudinally on a top surface of the cover member (100).

6. The pen assembly of claim 1 wherein the cover member (100) has external ribs disposed annularly on a top surface of the cover member (100).

7. A pen assembly comprising;

(a) a cover member (300) having:

(i) a proximal cover member (301) having a proximal cover member aperture (306);

(ii) a distal cover member (303) having a distal cover member channel (308) fluidly connected to a distal cover member aperture (307); and (iii) a cover member cavity (305) fluidly connected to the proximal cover member aperture (306) and the distal cover member channel (308);

(b) an annular washer (400) having a narrow opening (401) and a washer annular ridge (403); and (c) an adapter (500) having an adapter posterior section (501), an adapter anterior section (503), and an adapter midsection (505), wherein the adapter anterior section (503) has a proximal anterior section end (504) and a distal anterior section end (502), wherein a geometry of the adapter anterior section (503) is such that an anterior end diameter decreases from the proximal anterior section end (504) to the distal anterior section end (502), wherein the adapter (500) further comprises;

(i) an adapter annular ridge (511) disposed on the cross-section of the transverse plane of the adapter midsection (505) wherein the maximum adapter anterior section exterior diameter, (d1), is larger than an external diameter, (d2), of the adapter annular ridge (511);

(ii) a first adapter annular groove (507) disposed on a cross-section of a transverse plane of the adapter midsection (505) between the adapter posterior section (501) and the adapter annular ridge (511); and (iii) a second adapter annular groove (509) disposed on the cross-section of the transverse plane of the adapter midsection (505) between the adapter anterior section (503) and the adapter annular ridge (511), wherein the second adapter annular groove (509) is inserted into the annular washer (401), via the narrow opening (401), such that the washer annular ridge (403) snuggly and slidably interfaces with the second adapter annular groove (509), wherein the adapter anterior section (503) is inserted into the cover member cavity (305), via the proximal cover member aperture (306), such that an external surface of the annular washer (400) contacts an interior surface of the proximal cover member (301) and is attached via an adhesive, wherein the annular washer (400) is flush with the proximal cover member (301), thus defining a first position of the pen assembly, wherein, in a second position, the washer annular ridge (403) snuggly and slidably interfaces with the first adapter annular groove (507), wherein a first movement of the cover member (300) towards the adapter posterior section (501) moves the pen assembly from the first position to the second position, wherein a second movement of the cover member (300) towards the adapter anterior section (503) moves the pen assembly from the second position back to the first position, wherein, while in the first position, the cover member (300) is prevented from being detached from the adapter (500) as a result of a height of the washer annular ridge (403) relative to a first depth, which is a depth of the second adapter annular groove (509) relative to the adapter anterior section (503), wherein, while in the second position, the cover member (300) is prevented from being moved beyond the adapter posterior section (501) as a result of the height of the washer annular ridge (403) relative to a second depth, which is a depth of the first adapter annular groove (507) relative to the adapter posterior section (501).

8. The pen assembly of claim 7 further comprising:

(a) an adapter channel disposed on a central axis of the adapter (500) and extending a length of the adapter (500);

(b) a pen housing (10) having a housing anterior end (11), a housing posterior end (13), and a housing cavity (15) fluidly coupled to a housing anterior end aperture and a housing posterior end aperture;

(c) an ink cartridge (20); and (d) a plug (30), wherein, prior to joining the cover member (300) and the adapter (500), the ink cartridge (20) is inserted into the adapter channel such that the ink cartridge (20) extends beyond the distal anterior section end (502) and a portion of the ink cartridge (20) extends beyond the adapter posterior section (501). wherein the extending portion is then inserted into the housing cavity (15) and the adapter posterior section (501) is slidably inserted into the housing cavity (15), via the housing anterior end aperture, wherein the plug (30) is then sealably attached to the housing posterior end aperture, wherein the cover member (300) is then joined to The adapter (500).

9. The pen assembly of claim 8, wherein the first position is an open position, wherein the ink cartridge (20) extends through the distal cover member channel (308) and beyond the distal cover member aperture (307).

10. The pen assembly of claim 8, wherein the second position is a closed position, wherein the ink cartridge (20) resides within the distal cover member channel (308).

11. The pen assembly of claim 7, wherein the cover member (300) has external ribs disposed longitudinally on a top surface of the cover member (300).

12. The pen assembly of claim 7, wherein the cover member (300) has external ribs disposed annularly on a top surface of the cover member (300).

13. A pen assembly comprising:

(a) a cover member (100) having:

(i) a proximal cover member end (101) having a proximal cover member aperture (106);

(ii) a distal cover member end (103) having a distal cover member channel (108) fluidly connected to a distal cover member aperture (107); and (iii) a cover member cavity (105) fluidly connected to the proximal cover member aperture (106) and the distal cover member channel (108), wherein a cover member annular ridge (109) is disposed within the cover member cavity (105) at the proximal cover member end (101); and (b) an adapter (200) having an adapter posterior section (201), an adapter anterior section (203), and an adapter midsection (205), wherein the adapter anterior section (203) has a proximal anterior section end (204) and a distal anterior section end (202), wherein a geometry of the adapter anterior section (203) is such that an adapter anterior section diameter decreases from the proximal anterior section end (204) to the distal anterior section end (202), wherein an exterior diameter, (d1A), of the adapter anterior section (203) at the cover member annular ridge (109), upon compression, approaches the maximum adapter midsection (205) exterior diameter, (d2A), wherein the adapter (200) further comprises:

(i) an adapter annular ridge (211) disposed on the cross-section of the transverse plane of the adapter midsection (205)

(ii) a first adapter annular groove (207) disposed on a cross-section of a transverse plane of the adapter midsection (205) between the adapter posterior section (201) and the adapter annular ridge (211);

(iii) a second adapter annular groove (209) disposed on the cross-section of the transverse plane of the adapter midsection (205) between the adapter anterior section (203) and the adapter annular ridge (211); and (iv) a slit (213) disposed through a surface of the adapter anterior section (203), wherein the slit (213) extends a length of the adapter anterior section (203) and terminates at the adapter midsection (205), wherein the adapter anterior section (203) is configured to be inserted into the cover member cavity (105), via the proximal cover member aperture (106), causing the cover member (100) to compress the adapter anterior section (203), closing the slit (213), and thus allowing the proximal cover member end (101) to slide over the adapter anterior section (203), wherein the cover member annular ridge (109) snuggly and slidably interfaces with the second adapter annular groove (209), thus defining a first position of the pen assembly, wherein a first movement of the cover member (100) towards the adapter posterior section (201) moves the pen assembly from the first position to a second position such that the cover member annular ridge (109) snuggly and slidably interfaces with the first adapter annular groove (207), wherein a second movement of the cover member (100) towards the adapter anterior section (203) moves the pen assembly from the second position back to the first position, wherein, while in the first position, the cover member (100) is prevented from being detached from the adapter (200) as a result of a height of the first annular ridge (109) relative to a first depth, which is a depth of the second adapter annular groove (209) relative to the adapter anterior section (203), wherein, while in the second position, the cover member (100) is prevented from being moved beyond the adapter posterior section (201) as a result of the height of the first annular ridge (109) relative to a second depth, which is a depth of the first adapter annular groove (207) relative to the adapter posterior section (201).

* * * * *